United States Patent [19]

Babcock

[11] 4,138,103

[45] Feb. 6, 1979

[54] MODEL AIRCRAFT CONTROL SYSTEM

[76] Inventor: Alan W. Babcock, 2839 W. Fairmont #103, Fresno, Calif. 93705

[21] Appl. No.: 823,359

[22] Filed: Aug. 10, 1977

[51] Int. Cl.[2] ..... A63H 27/04

[52] U.S. Cl. ..... 272/31 A

[58] Field of Search ..... 272/31 A, 31 B, 31 R, 272/34, 35; 46/76 R, 76 A, 77, 78, 210, 1 B, 1 H, 249, 253; 35/12 L, 12 P, 12 W, 12 R, 11 R, 11 A; 273/95 B; 74/99 R, 99 A

[56] References Cited

U.S. PATENT DOCUMENTS

| | | | |
|---|---|---|---|
| 2,390,307 | 12/1945 | Kelecius | 272/31 A |
| 2,676,014 | 4/1954 | Smith | 272/31 B |
| 2,913,243 | 11/1959 | Cottle | 272/31 A |
| 2,913,244 | 11/1959 | Cottle, Jr. | 272/31 A |
| 3,446,502 | 5/1969 | Damron et al. | 272/31 A |

FOREIGN PATENT DOCUMENTS

| | | | |
|---|---|---|---|
| 600308 | 4/1948 | United Kingdom | 272/31 A |

*Primary Examiner*—William H. Grieb
*Assistant Examiner*—Arnold W. Kramer

[57] ABSTRACT

A control mechanism for captive model airplanes enabling the operator to remain outside the flight circle while controlling the flight of the plane including a flexible tower mounted on a fixed base, and on the tower a rotating disc, a bracket assembly having a lower convex surface pivoted and biased on the disc, a shaft slidable in the tower with an end contacting the convex surface of the bracket to change its biasing; a control box having a movable stick with a line attached thereto and trained over pulleys in the tower to adjust the bias of the bracket to which are attached control lines to the plane's controls to vary the altitude of the plane.

1 Claim, 4 Drawing Figures

MODEL AIRCRAFT CONTROL SYSTEM

FIELD OF THE INVENTION

This invention relates to a control mechanism for model aircrafts wherein a tower is used to control the flight pattern and a simplified control device is placed outside the flight circle and operatively connected with the tower.

THE PRIOR ART

Model planes control systems are becoming extremely popular and are receiving widespread attention and acceptance.

The prior art, as exemplified by U.S. Pat. Nos.: 2,390,307; 2,832,175; 2,913,244 and 3,204,952 generally illustrative of various control devices of this type. While such devices are generally acceptable for their intended purpose, they have not proven to be entirely satisfactory in that they are either complex and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a control system of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS

In the accompanying drawing, in which is shown one of the various possible illustrative embodiments of this invention, wherein like reference character identify the same or like parts.

DESCRIPTION OF THE PREFERRED EMBODIMENT

Figure 1:
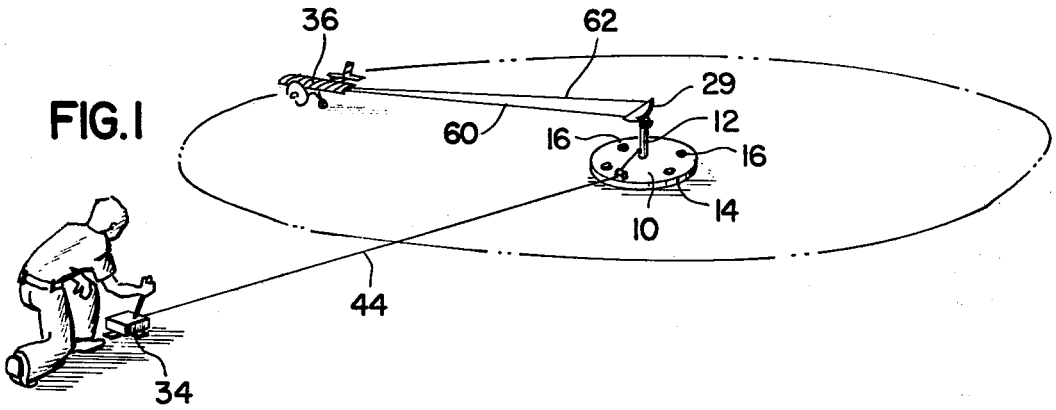
FIG. 1 is a perspective view of a model airplane system constructed in accord with the invention.

With reference to the drawing, there is shown and illustrated a MODEL AIRPLANE CONTROL SYSTEM constructed in accordance with the principles of the invention and designated generally by reference character 10.

Briefly, this invention is comprised of a tower 12 made of bendable plastic and integral with or fixed to a base 14 secured to the ground by spikes 16. Tower 12 has a central bore 48 therethrough in which is slidably mounted rod 18. Stops 20 are mounted at each end of the bore. Rotatably mounted on an extension 15 in recess 17 of a top tower 12 is a disc 22 in contact with ball bearings 27 in race 26 between the inside of the disc and the outer surface of extension 15. Pivoted on top of disc 22 on pivot 28 is a convex rocking member 29 in contact with the rounded upper end 30 of rod 18. On the other side of rod 18 from pivot 28 is a tension spring 32 connected between member 29 and disc 22. Spring 32 biases member 29 toward disc 22.

Figure 4:
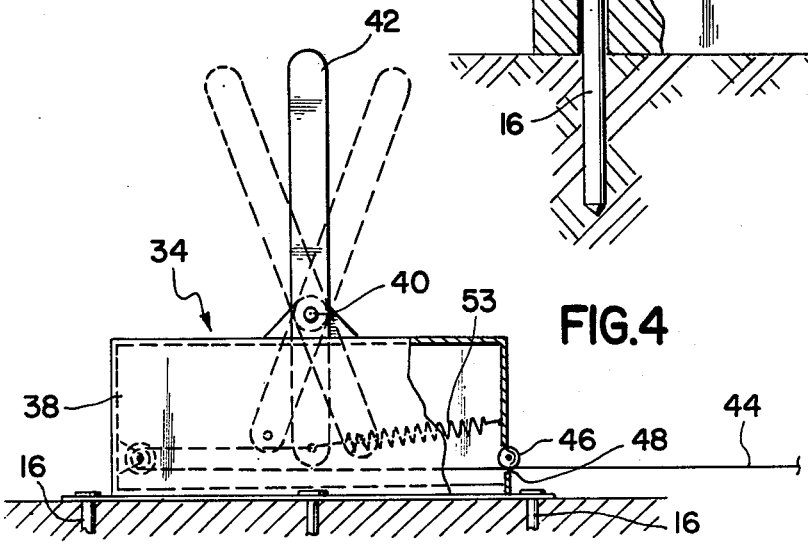
FIG. 4 is a front elevation partly in section showing the control device.

FIG. 4 shows control device 34 positioned outside the line of flight of model plane 36 (FIG. 1). This device includes a frame 38 fixed in the ground by spikes 16. Pivoted in an opening in frame 38 at 40 is a control stick 42 the lower end of which is connected to line 44 on roller 46 in opening 48 of the frame.

Figure 2:
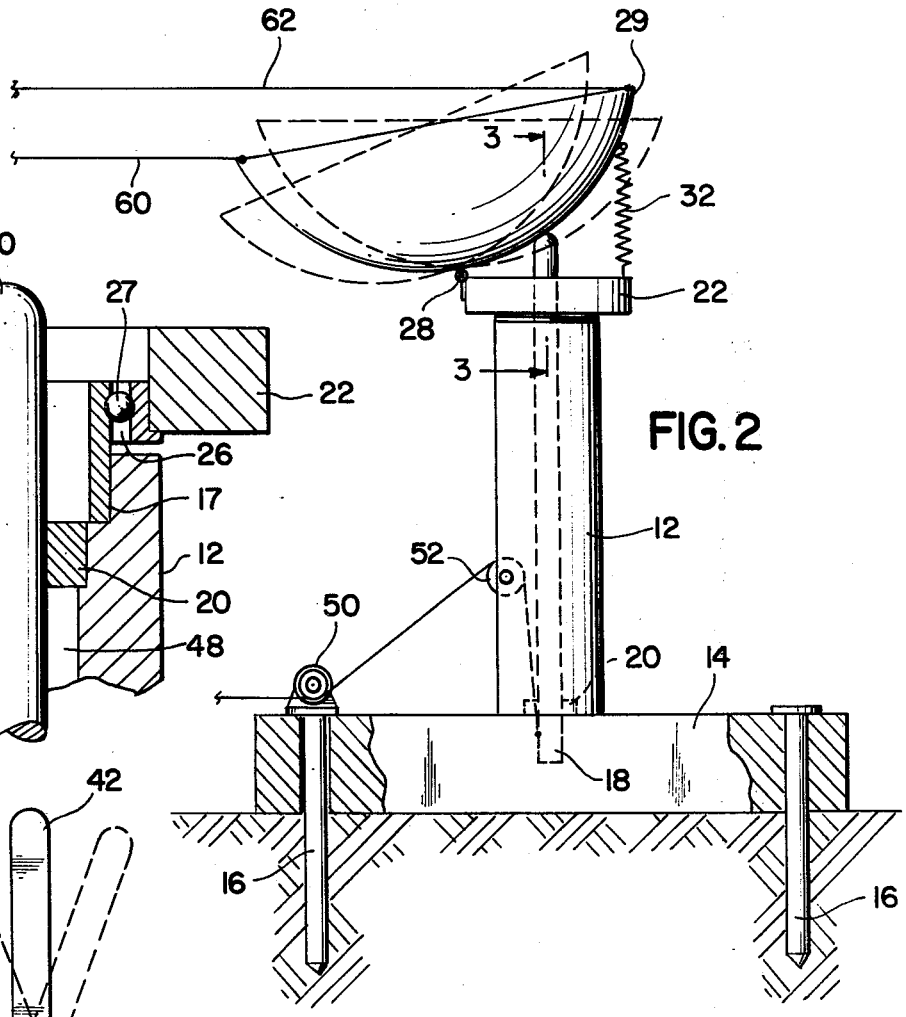
FIG. 2 is a front elevation partly in section of the control tower.
Figure 3:
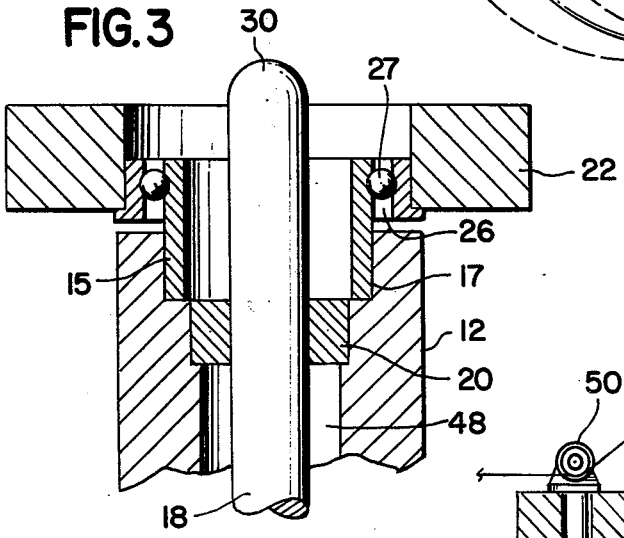
FIG. 3 is a partial cross-section taken along line 3—3 of FIG. 2 showing the upper part of the control tower.

FIG. 2 shows control line 44 trained on roller 50 fixed on base 14 and on roller 52 on tower 12 and with its end attached to the lower part of rod 18 so that by moving backward stick 42, rod 18 is caused to slide up and thereby tilt member 28 downwardly as shown by dotted lines in FIG. 2.

A pair of conventional model airplane control lines 60 and 62 are tied to the opposite ends of rocker member 29 and extend conventionally to the control portions of airplane 36 so that linear movement of the control lines in opposite directions causes either climbing or diving of the plane. Thus when stick 42 is pushed forward, line 44 slackens to allow spring 32 to urge rocker member 29 downwardly.

Preferably line 44 is of slippery consistency to reduce friction. Oil filled nylon of the type used for stringing rackets is recommended.

To give a better feel to the stick 42, a spring 53 can be stretched between the lower end of the stick and the frame.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefor, a more lengthy description is deemed unnecessary.

It is to be understood that various changes in shape, size and arrangement of the elements of this invention as claimed may be resorted to in actual practice, if desired.

Having thus described the invention, what is claimed as new and to be secured by Letters Patent is:

1. A model airplane control system comprising an upstanding tower, a revolvable disc mounted in free rotatable relation to the upper end of said tower; a rocking member pivoted on said disc above said disc and biased by spring means toward said disc; means on said rocking member to wiremount a model airplane; a rod slidabley mounted in said tower, said rod terminating in a convex upper end with said convex end of the rod bearing against the underside of said rocking member; a control device outside the line of flight of said airplane including a pivoted stick, a control line connected from said stick to the lower end of said rod to actuate said rod in axial motion and thereby pivot said rocking member in a desired direction for correspondingly controlling said airplane from said wires connected to said rocking member, in which a convex surface is formed on the underside of said rocking member so as to maintain the convex end of the rod in direct bearing relation with the rocking member as the rocking member rotates with respect to the rod and as the rocking member is pivoted by axial movement of the rod, and the bias of the spring means.

* * * * *